US011299935B2

(12) United States Patent
Xiao et al.

(10) Patent No.: US 11,299,935 B2
(45) Date of Patent: Apr. 12, 2022

(54) ELECTRIC DRILLING TOOL SUITABLE FOR OCEAN UNDERWATER DRILLING RIG

(71) Applicant: China University of Petroleum (East China), Shandong (CN)

(72) Inventors: Wensheng Xiao, Shandong (CN); Lianpeng Mei, Shandong (CN); Junguo Cui, Shandong (CN); Zhanpeng Liu, Shandong (CN); Liping Tan, Shandong (CN)

(73) Assignee: China University of Petroleum (East China), Shandong (CN)

( * ) Notice: Subject to any disclaimer, the term of this patent is extended or adjusted under 35 U.S.C. 154(b) by 0 days.

(21) Appl. No.: 17/110,544

(22) Filed: Dec. 3, 2020

(65) Prior Publication Data

US 2022/0025707 A1 Jan. 27, 2022

(30) Foreign Application Priority Data

Jul. 21, 2020 (CN) ..... 202010703522.3

(51) Int. Cl.
*E21B 4/04* (2006.01)
*E21B 17/02* (2006.01)
*E21B 7/12* (2006.01)

(52) U.S. Cl.
CPC ..... *E21B 4/04* (2013.01); *E21B 7/12* (2013.01); *E21B 17/028* (2013.01)

(58) Field of Classification Search
CPC ..... E21B 4/04; E21B 17/028; E21B 7/12
See application file for complete search history.

(56) References Cited

U.S. PATENT DOCUMENTS 3,497,019 A * 2/1970 Ortloffjohne ..... E21B 44/02 175/27
6,629,570 B1 * 10/2003 Head ..... E21B 4/02 175/61
2011/0057810 A1 * 3/2011 Partouche ..... E21B 17/028 340/854.4
2016/0290061 A1 * 10/2016 Perkins ..... E21B 17/023

* cited by examiner

*Primary Examiner* — Nicole Coy
*Assistant Examiner* — Yanick A Akaragwe
(74) *Attorney, Agent, or Firm* — The Dobrusin Law Firm, P.C.

(57) ABSTRACT

An electric drilling tool suitable for ocean under rater drilling rig is provided, which belongs to the technical field of ocean drilling equipment and includes a power supply assembly, a motor assembly and a bit assembly. The power supply assembly includes a power distribution cabinet, a power supply cable and a cable plug. The motor assembly includes a connecting joint, an upper machine head, a motor housing, a stator assembly, a rotor assembly, a centering bearing, stabilizing bearings, a rotating shaft, a lower machine head and a protector. The bit assembly includes a transition joint and a bit.

8 Claims, 4 Drawing Sheets

ELECTRIC DRILLING TOOL SUITABLE FOR OCEAN UNDERWATER DRILLING RIG

CROSS REFERENCE TO RELATED APPLICATIONS

This application claims the priority of Chinese Patent Application No. 202010703522.3 entitled "Electric Drilling Tool Suitable for Ocean Underwater Drilling Rig" filed with the Chinese Patent Office on Jul. 21, 2020, which is incorporated herein by reference in its entirety.

TECHNICAL FIELD

The disclosure relates to an electric drilling tool, in particular to an electric drilling tool suitable for an ocean underwater drilling rig, and belongs to the technical field of ocean drilling equipment.

BACKGROUND ART

The amount of ocean oil resources in the world accounts about one-third of the total global oil resources, and the development and utilization of the ocean oil and gas resources, particularly the exploration and development of oil and gas resources in deep sea area, has become a hot field in energy strategy of various countries. With the development of ocean drilling equipment, it is desired to improve efficiency and reliability of drilling.

An ocean underwater drilling rig moves main drilling equipment from a floating platform (ship) to the seabed and carries out drilling operation on the seabed via feeding through coiled tubing, drilling fluid circulation and remote control. A downhole motor adapted to the coiled tubing drilling process is the core device of the ocean underwater drilling rig. The downhole motor includes screw drilling tools, turbine drilling tools, and electric drilling tools. Compared with screw drilling tools and turbine drilling tools, electric drilling tools have the advantages of a high drilling speed, a wide range of acceptable temperature, high control accuracy and so on. However, due to a structure form composed of an induction motor and a speed reducing mechanism, the existing electric drilling tools have the defects such as complex structure, low efficiency, poor reliability, and the speed reducing mechanism being easily worn, and are not suitable for the ocean underwater drilling rig.

SUMMARY

The disclosure aims to overcome the shortcomings in the prior art and provides an electric drilling tool suitable for ocean underwater drilling rig, with simple structure, high drilling efficiency and strong reliability.

In order to achieve the above object, the technical solutions adopted by the disclosure are as follows.

An electric drilling tool suitable for ocean underwater drilling rig includes power supply assembly, a motor assembly and a bit assembly. The power supply assembly includes a power distribution cabinet, a power supply cable and a cable plug. The motor assembly includes a connecting joint, an upper machine head, a motor housing, a stator assembly, a rotor assembly, stabilizing bearings, a thrust bearing, a rotating shaft, a lower machine head and a protector. The bit assembly includes a transition joint and a bit. The motor assembly has a hollow structure vertically penetrating through the motor assembly, which has an upper end connected with coiled tubing through the connecting joint and a lower end connected with the bit through the transition joint. One end of the power supply cable is connected with the power distribution cabinet, and another end of the power supply cable passes through the coiled tubing and is connected with the upper machine head through the cable plug.

In the electric drilling tool suitable for ocean underwater drilling rig as described above, the upper machine head is a hollow structure, which has an upper end connected with the connecting joint and a lower end connected with the motor housing. One side of the upper machine head is provided with a wire passing-through hole penetrating through the upper machine head in an axial direction.

In the electric drilling tool suitable for ocean underwater drilling rig as described above, the stator assembly includes a stator iron core, stator copper core segments and stator windings. The stator core and the stator copper core segments both have stator slots formed into closed slots. The stator windings are wound and fixed in the closed slots of the stator iron core and the stator copper core segments.

In the electric drilling tool suitable for ocean underwater drilling rig as described above, the stator iron core is segmented into several segments, the stator copper ore segments are connected at positions at which the stator iron core is segmented.

In the electric drilling tool suitable for ocean underwater drilling rig as described above, the rotor assembly includes a sleeve and permanent magnet blocks. The sleeve has a hollow structure, and is provided with grooves arranged axially and parallel to each other on an outer surface of the sleeve. A width of the grooves is equal to that of the permanent magnet blocks, the permanent magnet blocks are attached in the grooves.

In the electric drilling tool suitable for ocean underwater drilling rig as described above, the rotor assembly is segmented into several segments, and is connected with the rotating shaft through a flat key. The stabilizing bearings are provided at positions at which the rotor assembly is segmented. An outer ring of each of the stabilizing bearings is connected with corresponding each of the stator copper core segments, and an inner ring is connected with the rotating shaft.

In the electric drilling tool suitable for ocean underwater drilling rig as described above, the lower machine head has a hollow structure, which has an upper end connected with the motor housing, and a lower end connected with the protector. One side of the lower machine head is provided with an oil passing-through hole penetrating through the lower machine head in the axial direction. The protector has a hollow structure, and an oil storage capsule is arranged in an annular inner cavity of the protector.

In the electric drilling tool suitable for ocean underwater drilling rig as described above, the rotating shaft has a hollow structure, which has an upper end extending into the upper machine head, and an upper mechanical seal is arranged between the rotating shaft and the upper machine head. A lower end of the rotating shaft passes through the lower machine head and the protector, and is connected with the transition joint. The thrust bearing and a lower mechanical seal is arranged between the lower machine head and the rotating shaft. The transition joint has a hollow structure.

The beneficial effects of the embodiments are described as follows.

The electric drilling tool suitable for ocean underwater drilling rig according to the invention adopts low-speed and high-torque permanent magnet synchronous motor to supply power, cuts off a mechanical speed reducer as commonly provided in the existing electric drilling tools to directly drive the load, reducing failure points, and effectively improves drilling efficiency and reliability of drilling rig. Furthermore, the drilling tool has the advantages of a wide range of regulated speed, strong overload capacity and high control precision.

The electric drilling tool suitable for ocean underwater drilling rig according to the invention is provided with a driving motor which has a hollow structure vertically penetrating through the motor, to meet a requirement for drilling fluid circulation during a drilling operation.

The electric drilling tool suitable for ocean underwater drilling rig according to the invention is provided with the stator iron core and the rotor assembly each having a segmented structure, and the stator copper core segments and the stabilizing bearings are respectively arranged at the positions at which the stator iron core is segmented and the positions at which the rotor assembly is segmented, to ensure a uniform air gap between the stator and the rotor of the slender permanent magnet motor.

The electric drilling tool suitable for ocean underwater drilling rig according to the invention has a reliable sealing structure and is suitable for operation requirements for ocean underwater drilling rig, and the drilling tool has a simple, reasonable and compact structure, and is convenient for processing and manufacturing.

Figure 1:
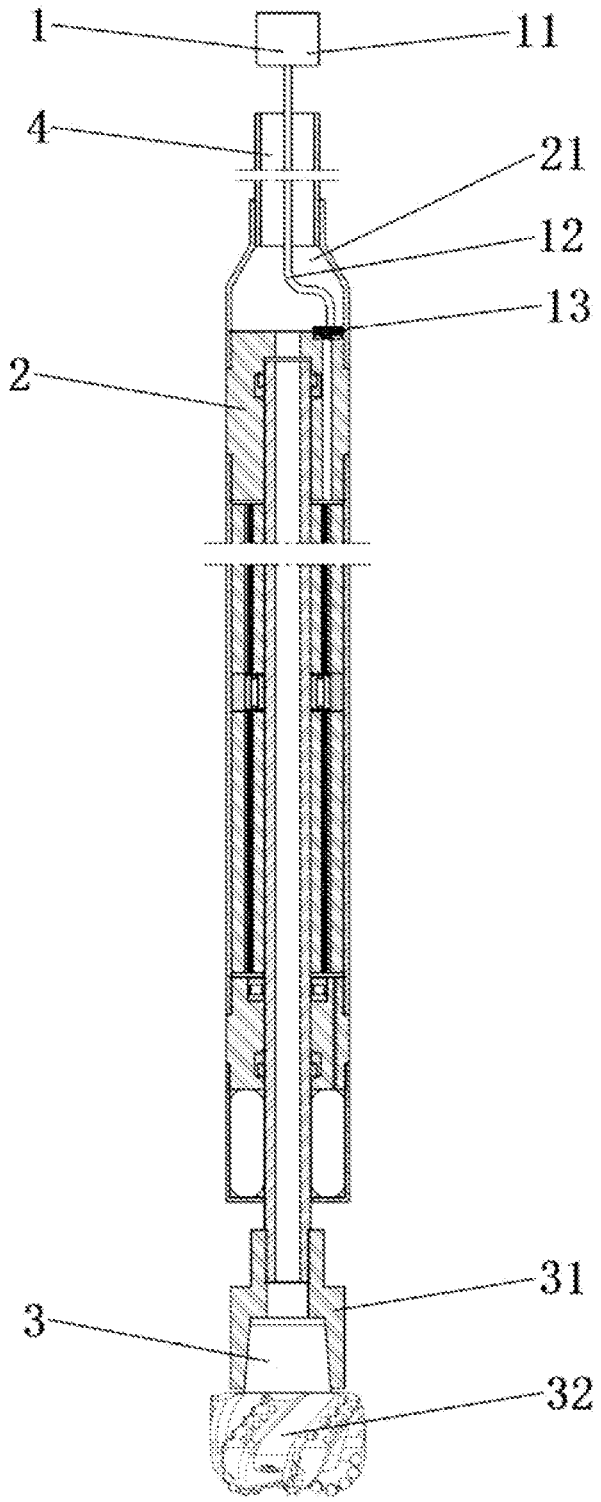
FIG. 1 is a schematic view of an overall structure according to the disclosure.

List of reference characters: 1 power supply assembly, 11 power distribution cabinet, 12 power supply cable, 13 cable plug; 2 motor assembly, 21 connecting joint, 22 upper machine head, 2201 wire passing-through hole, 23 motor housing, 24 stator assembly, 2401 stator on core, 2402 stator copper core segment, 2403 stator winding, 25 rotor assembly, 2501 sleeve, 2502 permanent magnet block, 2503 groove, 26 stabilizing bearing, 27 thrust bearing, 28 rotating shaft, 29 lower machine head, 2901 oil passing-through hole, 210 protector, 211 upper mechanical seal, 212 lower mechanical seal, 213 flat key, 214 oil storage capsule, 3 bit assembly, 31 transition joint, 32 bit, 4 coiled tubing 5 well wall

DETAILED DESCRIPTION OF THE EMBODIMENTS

Figure 2:
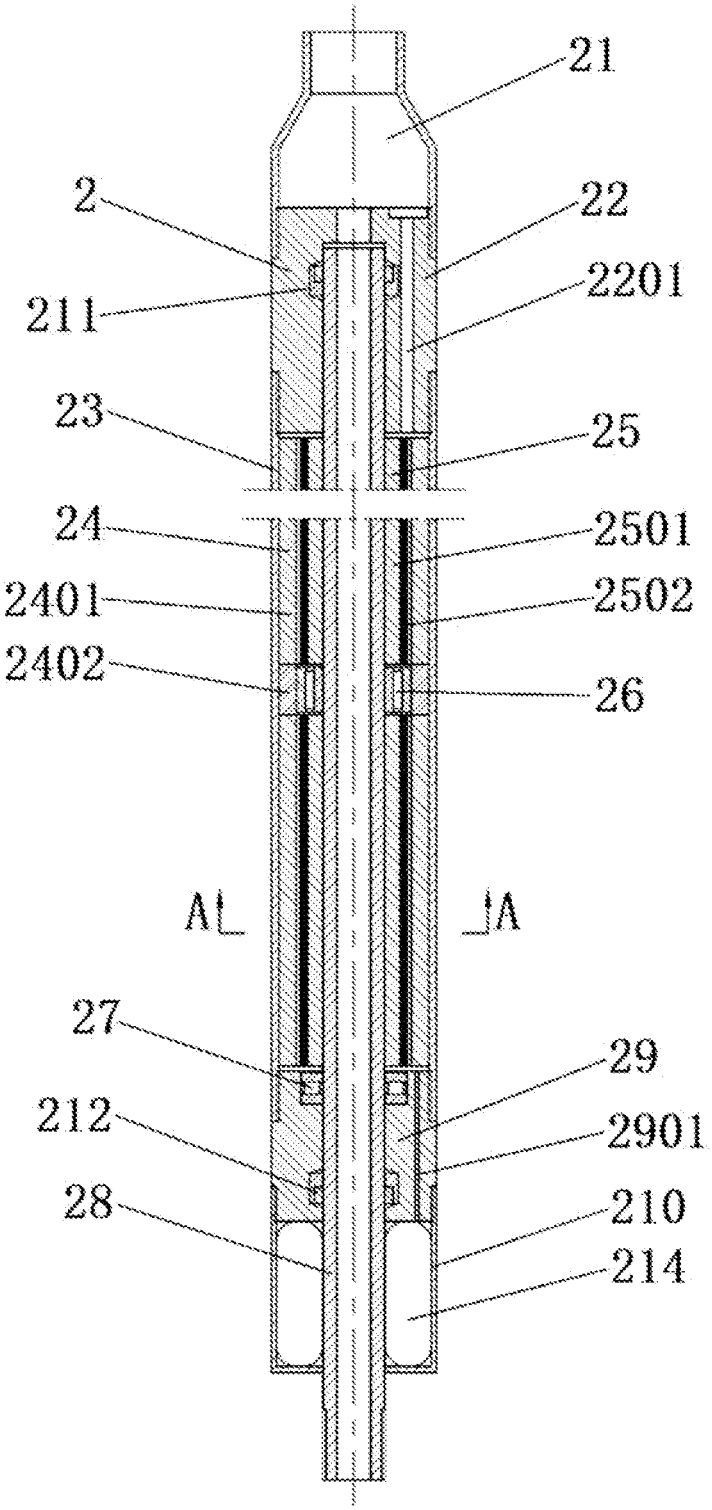
FIG. 2 is a schematic structure view of a motor assembly according to the disclosure.

The disclosure will be further described below in conjunction with the drawings and embodiments:

As shown in FIGS. 1 and 2, the disclosure provides an electric drilling tool suitable for an ocean underwater drilling rig. The electric drilling tool is adapted to coiled tubing drilling process based on the ocean underwater drilling rig and includes a power supply assembly 1, a motor assembly 2 and a bit assembly 3. The power supply assembly 1 includes a power distribution cabinet 11, a power supply cable 12 and a cable plug 13. The motor assembly 2 includes a connecting joint 21, an upper machine head 22, a motor housing 23, a stator assembly 24, a rotor assembly 25, stabilizing bearings 26, a thrust bearing 27, a rotating shaft 28, a lower machine head 29, and a protector 210. The bit assembly 3 includes a transition joint 31 and a bit 32. The motor assembly 2 is a hollow structure vertically penetrating the same for facilitating transmission of drilling fluid therein, so as to meet requirements for drilling fluid circulation during drilling operations. The upper end of the motor assembly 2 is connected to coiled tubing 4 through the connecting joint 21, and the lower end thereof is connected to the bit 32 through the transition joint 31. The connecting joint 21 and the transition joint 31 play a role of a connector of variable diameters. One end of the power supply cable 12 is connected to the power distribution cabinet 11, and the other end thereof passes through the coiled tubing 4 and is hermetically and conveniently inserted into a socket in the upper machine head 22 through the cable plug 13. The power distribution cabinet 11 is integrated into a control module for the ocean underwater drilling rig, and remotely supplies power to and controls a rotation speed of the drilling tool through cables.

As shown in FIG. 2, in the electric drilling tool suitable for ocean underwater drilling rig according to the disclosure, the upper machine head 22 is a hollow structure, which has n upper end connected to the connecting joint 21 and the lower end connected to the motor housing 23. One side of the upper machine head 22 is provided with a wire passing-through hole 2201 penetrating along an axial direction, so that via n electrical wire passing through the wire passing-through hole 2201, power supplied to the driving motor of the drilling tool.

Figure 3:
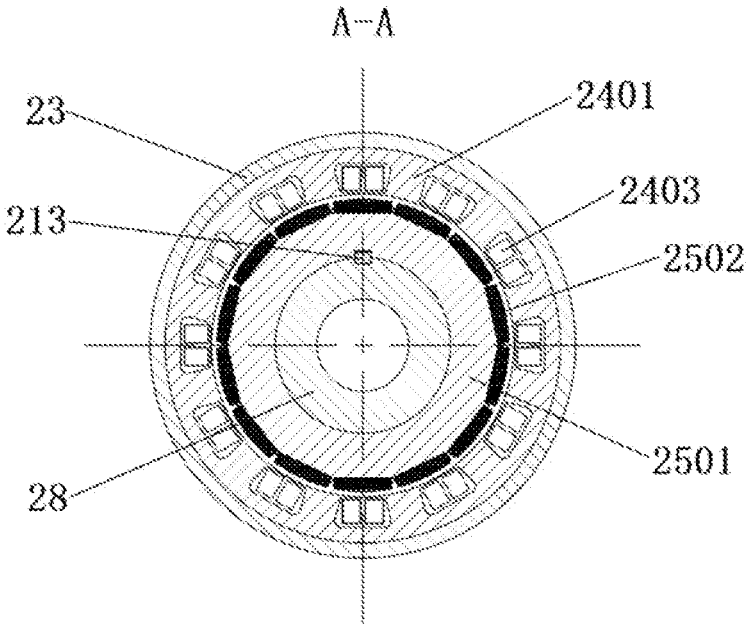
FIG. 3 is a cross-sectional view taken along line A-A of FIG. 2.
Figure 4:
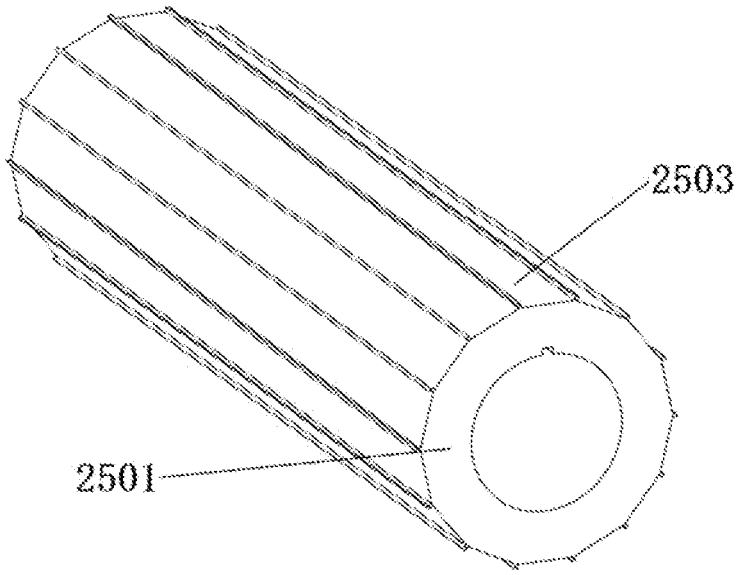
FIG. 4 is a perspective view of a sleeve according to the disclosure.

As shown in FIGS. 2, 3 and 4, in the electric drilling tool suitable for ocean underwater drilling rig according to the disclosure, the stator assembly 24 includes a stator iron core 2401, stator copper core segments 2402 and stator windings 2403. The stator core 2401 and the stator copper core segments 2402 are fixedly connected to an inner side of the motor housing 23, and the stator windings 2403 are wound and fixed in stator slots of the stator iron core 2401 and the stator copper core segments 2402. The stator slots of the stator iron core 2401 and the stator copper core segments 2402 are closed slots, which can effectively eliminate the torque pulsation caused by the motor for driving the drilling tool. The stator iron core 2401 is formed by laminating stator silicon steel sheets, and the stator copper core segments 2402 are formed by laminating copper sheets with the same shape as that of the stator silicon steel sheets. The rotor assembly 25 includes a sleeve 2501 and permanent magnet blocks 2502, the sleeve 2501 is a hollow structure and connected to the rotating shaft 28 through a flat key 213, so that the rotor assembly 25 can transmit torque to the rotating shaft 28. On the outer surface of the sleeve 2501, grooves 2503 are provided which extend axially in parallel with each other and have the same width as that of the permanent magnet blocks 2502. The permanent magnet blocks 2502 are attached in the grooves 2503 sequentially in a predetermined direction of magnetic pole, and fixed by installing a carbon fiber protective cover on an outer surface of the rotor assembly 25. In some embodiments, the stator windings 2403 in the embodiment adopt short-pitch and single-layer fractional slot windings, which have high efficiency and are convenient for installing the windings; the rotor assembly 25 adopts a surface-mounting structure with low magnetic leakage coefficient and large air gap flux, and is convenient for manufacturing and installing.

As shown in FIG. 2, in the electric drilling tool suitable for the ocean underwater drilling rig according to the disclosure, due to a limitation of radial size of a downhole space, an axial length of the motor assembly 2 is increased to meet a power demand for performing drilling operations by the drilling tool, resulting in a larger ratio of length to diameter of the motor assembly 2 and a ultra slender structure of the motor assembly 2. During drilling operations, the slender rotor occurs large deflection deformation in a case of no support for supporting the rotor, which may cause uneven air gaps between the stator and rotor of the motor and even a scratching accident between stator and rotor. In view of this, the rotor assembly 25 is equally divided into at least two segments according to the length of the motor, and each of the stabilizing bearings 26 for supporting the elongated rotating shaft 28 is provided at a segmented position. Since the rotor assembly 25 has a segmented structure, the stator also needs to be segmented accordingly. The stator iron core 2401 is equally divided into segments corresponding to the segments of the rotor assembly 25. The stator copper core segments 2402 for magnetic isolation are arranged at the segmented positions, and a position of each of the stator copper core segments 2402 corresponds to a position of a corresponding each of the stabilizing bearings 26. Preferably, an outer ring of each of the stabilizing bearings 26 is connected to the corresponding each of the stator copper core segments 2402 and an inner ring thereof is connected to the rotating shaft 28.

As shown in FIG. 2, in the electric drilling tool suitable for ocean underwater drilling rig according to the disclosure, the lower machine head 29 is a hollow structure, which has an upper end connected with the motor housing 23 and a lower end connected with the protector 210. One side of the lower machine head is provided with an oil passing-through hole 2901 which penetrates the lower machine head in the axial direction so as to communicate an inner cavity of the motor and the oil storage capsule 214 of the protector 210. In order to save installation space, the protector 210 is designed as a hollow structure for the rotating shaft 28 passing therethrough, and the oil storage capsule 214 is provided in an annular inner cavity of the protector 210. The motor inner cavity formed among the rotating shaft 28, the upper machine head 22, the lower machine head 29, and the motor housing 23 is filled with transformer oil with high dielectric strength to play roles of lubrication, heat dissipation, insulation and isobaric sealing. When the transformer oil in the inner cavity of the motor expands and contracts due to a temperature change, the protector 210 plays a role of compensating a volume change of the transformer oil, and further, the protector 210 can balance between a pressure in the inner cavity and a pressure at the outside of the motor to render a seal reliable and ensure that motor for driving the drilling tool works normally under high pressure and high temperature conditions.

As shown in FIGS. 1 and 2, in the electric drilling tool suitable for ocean underwater drilling rig according to the disclosure, the rotating shaft 28 is a hollow structure, which has an upper end extending into the upper machine head 22, and an upper mechanical seal 211 is provided between the upper machine head 22 and the rotating shaft 28. A lower end of the rotating shaft 28 passes through the lower machine head 29 and the protector 210 to be connected with the transition joint 31, and a thrust bearing 27 and a lower mechanical seal 212 is arranged between the lower machine head 29 and the rotating shaft 28. The transition joint 31 is a hollow structure which plays a role of connecting the rotating shaft 28 and the bit 32 in a manner of variable diameters. Preferably, a static ring of the upper mechanical seal 211 is connected with the upper machine head 22, and a dynamic ring of the upper mechanical seal 211 is connected with the rotating shaft 28; a static ring of the lower machine seal 212 is connected with the lower machine head 29, and the dynamic ring of the lower machine seal 212 is connected with the rotating shaft 28; a seat ring of the thrust bearing 27 is connected to the lower machine head 29 and a shaft ring of the thrust bearing 27 is connected to the rotating shaft 28. By providing the upper and the lower mechanical seals, external liquid cannot enter the inner cavity of the motor even when the rotating shaft 28 rotates, so that a requirement on insulation of the inner cavity of the motor is satisfied. The thrust bearing 27 is arranged to fix a position of the stator relative to the rotor of the motor for driving the drilling tool in the axial direction, and the thrust bearing 27 axially bears weight of the motor rotor and the bit assembly 3 and bears an axial reaction force applied on the bit 32 from the stratum during drilling operations with the drilling tool.

The electric drilling tool suitable for ocean underwater drilling rig accordingly to the disclosure adopts a low-speed and high-torque permanent magnet synchronous motor as the driving motor, and cuts off a speed reducer as provided in the traditional electric drilling tool to directly drive the load, reducing failure points. The electric drilling tool has the advantages of simple structure, high transmission efficiency, wide speed regulation range and high control precision, and greatly improves overall drilling efficiency and reliability of the drilling rig. In addition, the disclosure has strong sealing reliability and a wide range of acceptable temperature, and meets the use requirement for ocean underwater drilling rig.

Figure 5:
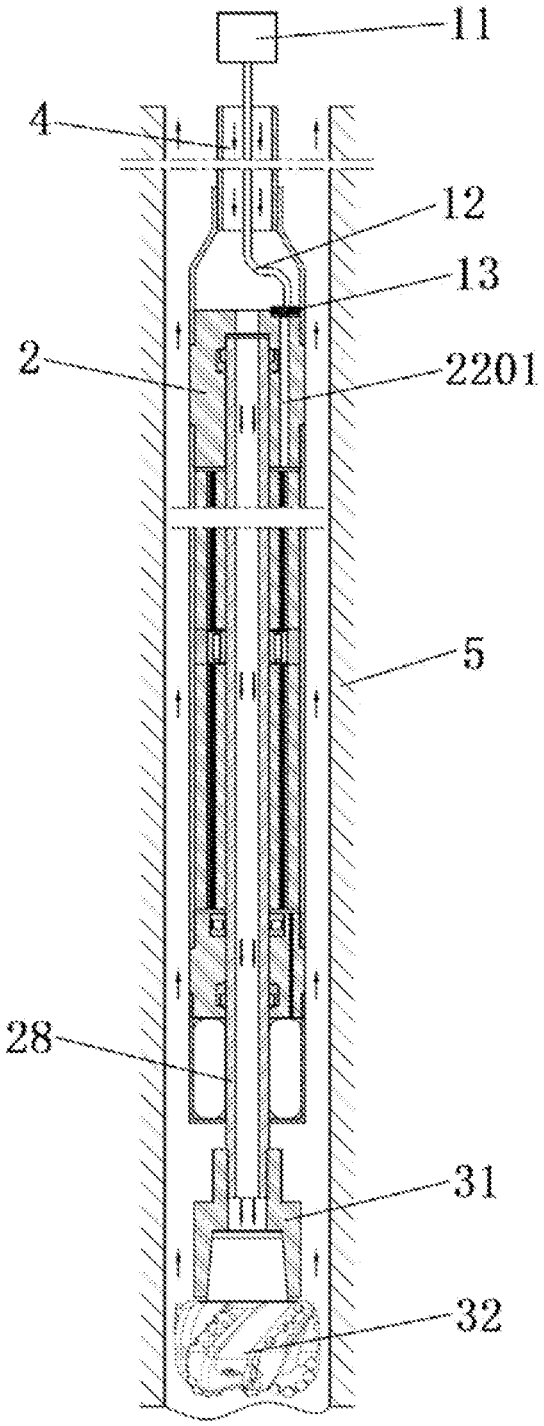
FIG. 5 is a schematic view of a drilling process according to the disclosure.

As shown in FIG. 5, a specific drilling process according to the disclosure is as follows: before starting the drilling, the underwater drilling equipment is firstly transported to a predetermined seabed location by controlling a seabed walking device of the ocean underwater drilling rig, and the drilling tool according to the disclosure placed by a drilling derrick and a manipulator at a predetermined position of the wellhead, for drilling operations.

In normal drilling, a feed force of the coiled tubing 4 and the weight of the drilling tool a applied to the bit 32 as a bit pressure. Three-phase alternating current from the power distribution cabinet 11 which is integrated into the control module of the ocean underwater drilling rig is supplied to the motor assembly 2 through the power supply cable 12 and then is transmitted to the stator through the cable plug 13 via the wire passing through the wire passing-through hole 2201, so as to supply power to and perform a speed control on the motor for driving the drilling tool. Once the stator is energized, a rotating magnetic field is generated, which causes the rotating shaft 28 to rotate with the rotation of the rotor, and in turn drives the bit 32 to drill. Meanwhile, the drilling fluid is transmitted by a drilling fluid circulating device through the oiled tubing 4 to the drilling tool, flows through the motor assembly 2 with the hollow structure, the transition joint 31 and a water outlet of the bit 32 to a bottom of the well so as to cool the bit 32, and is returned to the wellhead through the annular space among the drilling tool, the coiled tubing 4 and the well all 5, along with rock debris.

After drilling, the drilling tool is lifted to the wellhead through a feeding device of the coiled tubing 4 and a fishing tool.

What is claimed is:

1. An electric drilling tool for an ocean underwater drilling rig, comprising:

a power supply assembly, having a power distribution cabinet, a power supply cable, and a cable plug;

a motor assembly, having a connecting joint, an upper machine head, a motor housing, a stator assembly, a rotor assembly, stabilizing bearings, a thrust bearing, a rotating shaft, a lower machine head and a protector;

a bit assembly, having a transition joint and a bit;

wherein the motor assembly has a hollow structure vertically penetrating through the motor assembly, which has an upper end connected with a coiled tubing through the connecting joint and a lower end connected with the bit through the transition joint;

wherein one end of the power supply cable is connected with the power distribution cabinet, and another end of the power supply cable passes through the coiled tubing and is connected with the upper machine head through the cable plug;

wherein the stator assembly comprises a stator iron core, stator copper core segments, and stator windings;

wherein the stator iron core and the stator copper core segments both have stator slots formed into closed slots; and wherein the stator windings are wound and fixed in the closed slots of the stator iron core and the stator copper core segments.

2. The electric drilling tool according to claim 1, wherein the upper machine head is a hollow structure, which has an upper end connected with the connecting joint, and a lower end connected with the motor housing; and wherein one side of the upper machine head is provided with a wire passing-through hole penetrating through the upper machine head in an axial direction.

3. The electric drilling tool according to claim 1, wherein the stator iron core has a segmented structure; and wherein the stator copper core segments are connected at positions at which the stator iron core is segmented.

4. The electric drilling tool according to claim 1, wherein the rotor assembly comprises a sleeve and permanent magnet blocks;

wherein the sleeve has a hollow structure, and is provided with grooves arranged axially and parallel to each other on an outer surface of the sleeve;

wherein the grooves have a width equal to that of the permanent magnet blocks; and wherein the permanent magnet blocks are attached in the grooves.

5. The electric drilling tool according to claim 4, wherein the rotor assembly presents a segmented structure and is connected with the rotating shaft through a flat key;

wherein the stabilizing bearings are provided at positions at which the rotor assembly is segmented; and wherein an outer ring of each of the stabilizing bearings is connected with the stator copper core segments, and an inner ring of each of the stabilizing bearings is connected with the rotating shaft.

6. The electric drilling tool according to claim 1, wherein the rotor assembly presents a segmented structure and is connected with the rotating shaft through a flat key;

wherein the stabilizing bearings are provided at positions at which the rotor assembly is segmented; and wherein an outer ring of each of the stabilizing bearings is connected with the stator copper core segments, and an inner ring of each of the stabilizing bearings is connected with the rotating shaft.

7. The electric drilling tool according to claim 1, wherein the lower machine head has a hollow structure, which has an upper end connected with the motor housing and a lower end connected with the protector;

wherein one side of the lower machine head is provided with an oil passing-through hole penetrating through the lower machine head in the axial direction; and wherein the protector has a hollow structure, and an oil storage capsule is arranged in an annular inner cavity of the protector.

8. The electric drilling tool according to claim 1, wherein the rotating shaft has a hollow structure, which has an upper end extending into the upper machine head, and an upper mechanical seal is arranged between the rotating shaft and the upper machine head;

wherein a lower end of the rotating shaft passes through the lower machine head and the protector to be connected with the transition joint, and the thrust bearing and a lower mechanical seal is arranged between the lower machine head and the rotating shaft; and wherein the transition joint has a hollow structure.

* * * * *